United States Patent [19]

Tischer et al.

[11] Patent Number: 4,505,685

[45] Date of Patent: Mar. 19, 1985

[54] METHOD OF MANUFACTURING DISPLAY STRUCTURES

[75] Inventors: Kurt M. Tischer, Wendlingen; Klaus-Peter Voigt, Esslingen; Rolf Zondler, Stuttgart, all of Fed. Rep. of Germany

[73] Assignee: International Standard Electric Corporation, New York, N.Y.

[21] Appl. No.: 340,928

[22] Filed: Jan. 20, 1982

[30] Foreign Application Priority Data

Jan. 22, 1981 [DE] Fed. Rep. of Germany ..... 3101872

[51] Int. Cl.[3] ..... H01J 9/02

[52] U.S. Cl. ..... 445/24; 427/108; 427/126.2; 156/660

[58] Field of Search ..... 445/24, 25, 49; 427/108, 126.2, 259; 156/660

[56] References Cited

U.S. PATENT DOCUMENTS

| | | | |
|---|---|---|---|
| 3,052,581 | 9/1962 | Gutknecht | 156/660 |
| 4,009,061 | 2/1977 | Simon | 156/659.1 |
| 4,158,794 | 6/1979 | Sandler | 315/105 X |
| 4,294,650 | 10/1981 | Werthmann | 156/660 |

FOREIGN PATENT DOCUMENTS

| | | | |
|---|---|---|---|
| 153647 | 11/1981 | Japan | 445/24 |

*Primary Examiner*—Kenneth J. Ramsey

*Attorney, Agent, or Firm*—T. L. Peterson; J. S. Christopher

[57] ABSTRACT

In the manufacture of display structures—including fluorescent material displays—by means of a print process, a base material (glass or plastic material), prior to the print process, is coated with an electrically conductive layer. During the print process, a strippable coating or pigmented lacquer having the shape of the structure, is deposited onto a first layer. After the print process, the non-printed electrically conductive layer is etched away and in the case of the non-fluorescent display structure, the strippable coating is peeled off the electrically conductive layer. The invention provides an improvement in the manufacture of display structures over the hitherto conventional photographic reproduction of silk-screen printing methods, and provides display structures having sharp edges to a thickness of approximately 10 μm.

9 Claims, 3 Drawing Figures

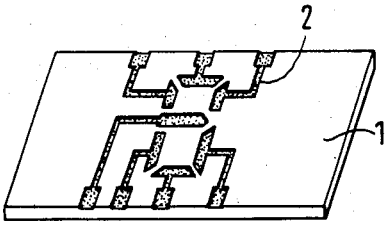
Fig. 1
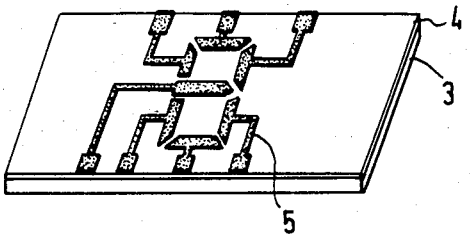
Fig. 1a
Fig. 2
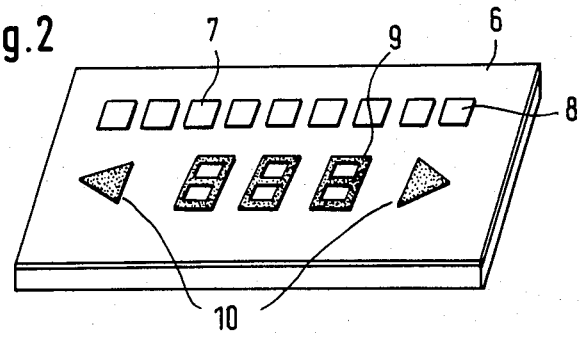

METHOD OF MANUFACTURING DISPLAY STRUCTURES

BACKGROUND OF THE INVENTION

1. Field of the Invention

The present invention relates generally to electronic display structures and more particularly to a method of manufacturing fluorescent display structures by means of a print process employing a printing carrier and an etching process.

2. Description of the Prior Art

In various fields of technology, myriad displays currently are widely used with various types of indicating instruments, such as meters, computers, display terminals, etc., for the visual presentation of figures, letters, symbols, and the like. In manufacturing such displays it is desirable that they be as uniform as possible and have sharp (well defined) edges. For economy reasons, the method must be easy to perform and adapted for production in large quantities.

Up to now it was known to manufacture such structures for displays by employing either photographic reproduction or silk-screen printing processes. The resulting display structures, however, are unsuitable for meeting current and steadily increasing demands for distinctness and clarity of the display characters. Moreover, the number of display structures capable of being manufactured in accordance with the conventional methods of the prior art, is too small, and in many cases, the process is too complicated.

SUMMARY OF THE INVENTION

It is an object of the invention, therefore, to provide a method of manufacturing display structures by means of a print process, with the display structures having the desired properties and permitting economical manufacture.

It is an additional object of the invention to provide a method of manufacturing fluorescent display structures by means of a print process with the fluorescent display structures having optimal properties and permitting economical manufacture.

According to a preferred embodiment of the present invention, the objects are achieved in the following way. During the manufacture of display structures, a surface of a base (substrate) material, prior to the print process, is coated with an electrically conductive layer. A pattern of etch resistant, strippable coating which serves as a transfer material is deposited by printing onto the conductive layer coated on a top surface of the base material. The pattern has a shape congruent with the display structure and includes providing a print carrier in the form of a plate with concave impressions therein corresponding to the pattern shape. The strippable coating is applied to the concave impressions by a tampon-type print pad prior to printing the pattern onto the conductive layer. The conductive layer is then etched away except where the printed pattern has been deposited. At the end of the process, the etch resistant, strippable coating is stripped off of the top surface of the base material leaving only the display structure which is the unetched portion of the conductive layer. In manufacturing fluorescent display structures, a pigmented lacquer containing a fluorescent material as a pigment is deposited on the conductive layer during the printing process and serves as the transfer material while the remainder of the original process is repeated.

An advantage of the present invention is that an economical method of manufacturing display structures using a print process is provided with the display structures having characters with sharp edges.

An additional advantage of the present invention is that an economical method of manufacturing fluorescent display structures using a print process is provided with the fluorescent display structures having optimal properties.

A further advantage of fhe present invention is that improved adhesion of the fluorescent material within the fluorescent display structure after fritting the vacuum-fluorescent display is achieved by employing a photo-sensitive lacquer.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

FIG. 1 shows a base plate including the pattern of the desired display structure etched therein.

FIG. 1*a* shows a substrate and conductive layer with deposited transfer material in the desired pattern, ready for etching.

FIG. 2 depicts a typical fluorescent material deposition for a vacuum-fluorescent display arrangement.

DETAILED DESCRIPTION OF THE PREFERRED EMBODIMENT

One embodiment of the invention is shown in FIG. 1 and FIG. 1*a*. A base (substrate) material or baseplate 1 is shown in FIG. 1 with a plurality of patterns 2 etched into the base plate 1. The plurality of patterns 2 represents the configuration of a display structure to be printed later on. From the baseplate 1, by means of a tampon-type print pad employed in a printing process, the above-mentioned display structure is transferred to a glass plate 3. During the manufacture of display structures, a surface of the glass plate 3 prior to the print process is coated with a transparent electrically conductive layer 4 (see FIG. 1*a*). The plurality of patterns 2 utilizing an etch resistant, strippable coating for serving as a transfer material is deposited by the print process onto the electrically conductive layer 4 and the glass plate 3. The plurality of patterns 2 of etch resistant, strippable material has a shape congruent with the display structure and includes providing the baseplate 1 as a print carrier. The baseplate 1 or print carrier includes a plurality of concave impressions corresponding to the shape of the plurality of patterns 2. The etch resistant, strippable coating is applied to the concave impressions by the tampon-type print pad prior to the printing of the plurality of patterns 2 onto the electrically conductive layer 4. The result is a printed structure 5 that masks portions of the transparent electrically conductive layer 4 on the glass plate 3 in such a way that, subsequently to the etching away of the electrically conductive layer 4 except where the printed pattern has been deposited, and subsequently to the stripping away of the etch resistant, strippable coating, only the masked portions of the electrically conductive layer 4 remain on the glass plate 3.

Relative thereto, it should be mentioned that in such a print process an acid-resistant, strippable coating is typically used as the transfer material. The electrically conductive layer 4 consists of indium-tin oxide and the base (substrate) material or baseplate 1 may be a plate of glass or a plate or board of plastic material.

As a further example of practical application there is mentioned the multi-colored printing with fluorescent materials which is suitable for display structures employing the vacuum-fluorescence principle. In manufacturing fluorescent display structures, a pigmented lacquer containing a fluorescent material as a pigment is deposited on the electrically conductive layer 4 during the printing process and serves as the transfer material. The remainder of the process is then repeated. The pigmented lacquer may for example have an inorganic composition such as water glass or an organic composition such as a soluble polymer or a water-soluble polymer. Examples of soluble polymers are acrylates, methacrylates, nitrocellulose and polyvinyl acetate and examples of water-soluble polymers are gelatine, casein, polyvinyl alcohol and polyvinyl pyrrolidone. On a glass plate 6 (FIG. 2) there is provided but not shown a plurality of indium-tin oxide structures which serve as the electrically conductive layer 4. By employing the method described hereinbefore, a plurality of arrangements 7 to 10 may be printed successively onto the display structures by using differently colored fluorescent material suspensions. This is of great importance for possible automatic production.

Improved adhesion of the colored fluorescent material suspensions within the display structures may be obtained by employing a photo-sensitive lacquer such as a mixture of polyvinyl alcohol/ammonium dichromate (PVA/ADC). The improved adhesion is obtained especially after the fritting of vacuum fluorescent displays. After the print process, the display structure deposited with the fluorescent material is exposed to ultraviolet light through the glass plate 6 or directly on the printed fluorescent material on the side of the display structure.

The advantages achievable with the aid of the present invention reside above all in that display structures and fluorescent material structures (up to a thickness of 10 μm), in a design having sharp edges can be simply manufactured and can be reproducible in large quantities.

We claim:

1. A method for manufacturing a conductive display structure of an electronic display using a printing process comprising the steps of:

providing a substrate as a base for a conductive display structure:

coating said substrate with an electrically conductive layer on a surface thereof;

printing a pattern of etch resistant, strippable material on said electrically conductive layer, said pattern having a shape congruent with said conductive display structure, said printing step including the steps of providing a print carrier in the form of a plate with concave impressions therein corresponding to said shape of said pattern, said pattern including an arrangement of electronic circuitry and applying said strippable material into said concave impressions by means of a tampon-type printing pad prior to the printing of said pattern onto said electrically conductive layer, said print carrier plate with said concave impressions contacting said electrically conductive layer of said substrate:

etching away said electrically conductive layer except where said printed pattern has been deposited; and stripping away said etch resistant, strippable material from said substrate thereby leaving said conductive display structure as the unetched residue of said etching step.

2. A method for manufacturing a conductive display structure of an electronic display using a printing process comprising the steps of:

providing a substrate as a base for a conductive display structure;

coating said substrate with an electrically conductive layer on a surface thereof;

printing a pattern of etch resistant, strippable material on said electrically conductive layer, said pattern having a shape congruent with said conductive display structure, said printing step including the steps of providing a print carrier in the form of a plate with concave impressions therein corresponding to said shape of said pattern, said pattern including an arrangement of electronic circuitry and applying said strippable material into said concave impressions by means of a tampon-type printing pad prior to the printing of said pattern onto said electrically conductive layer, said print carrier plate with said concave impressions contacting said electrically conductive layer of said substrate;

etching away said electrically conductive layer except where said printed pattern has been deposited;

stripping away said etch resistant, strippable material from said substrate thereby leaving said conductive display structure as the unetched residue of said etching step; and providing a pigmented lacquer containing a fluorescent pigmenting material as said strippable material.

3. The method according to claim 1 in which said step of providing said substrate comprises the step of providing a glass plate therefor.

4. The method according to claim 2 in which said step of providing said substrate comprises the step of providing a glass plate therefor.

5. The method according to claim 1 in which said step of providing said substrate comprises the step of providing a substrate of polymer plastic material.

6. The method according to claim 2 in which said step of providing said substrate comprises the step of providing a substrate of polymer plastic material.

7. The method according to claim 1 in which said step of coating said substrate with said electrically conductive layer comprises the step of coating said substrate with a layer of indium-tin oxide.

8. The method according to claim 2 in which said step of coating said substrate with said electrically conductive layer comprises the step of coating said substrate with a layer of indium-tin oxide.

9. A method for manufacturing a conductive display structure of an electronic display using a printing process comprising the steps of:

providing a substrate as a base for a conductive display structure:

coating said substrate with an electrically conductive layer on a surface thereof;

printing a pattern of etch resistant, strippable material on said electrically conductive layer, said pattern having a shape congruent with said conductive display structure, said printing step including the steps of providing a print carrier in the form of a plate with concave impressions therein corresponding to said shape of said pattern, said pattern including an arrangement of electronic circuitry and applying said strippable material into said concave impressions by means of a tampon-type printing pad prior to the printing of said pattern onto said electrically conductive layer, said print carrier plate with said concave impressions contacting said electrically conductive layer of said substrate;

etching away said electrically conductive layer except where said printed pattern has been deposited;

stripping away said etch resistant, strippable material from said substrate thereby leaving said conductive display structure as the unetched residue of said etching step;

providing a pigmented lacquer containing a fluorescent pigmenting material as said strippable material; and exposing said conductive display structure to an ultraviolet light through said substrate for improving the adhesion of said fluorescent pigmenting material.

* * * * *